United States Patent [19]

Swanson

[11] Patent Number: 4,498,673

[45] Date of Patent: Feb. 12, 1985

[54] GOLF CLUB

[76] Inventor: Arthur P. Swanson, 1454 Estate La., Glenview, Ill. 60025

[21] Appl. No.: 581,804

[22] Filed: Feb. 21, 1984

[51] Int. Cl.[3] ..... A63B 53/04

[52] U.S. Cl. ..... 273/172; 273/174; 273/171

[58] Field of Search ..... 273/174, 167 A, 78, 273/172, 171, 167 E, 173; D21/214, 215, 216, 220

[56] References Cited

U.S. PATENT DOCUMENTS

| | | | |
|---|---|---|---|
| 2,014,829 | 9/1935 | Young | 273/174 |
| 2,255,332 | 9/1941 | Russell | 273/174 |
| 2,447,967 | 8/1948 | Stone | 273/78 |
| 2,708,579 | 5/1955 | Hugman | 273/174 X |
| 3,199,873 | 8/1965 | Surratt | 273/174 X |
| 3,680,868 | 8/1972 | Jacob | 273/174 |
| 3,815,921 | 6/1974 | Turner | 273/174 |
| 3,961,796 | 6/1976 | Thompson | 273/167 A |
| 4,065,133 | 12/1977 | Gordos | 273/167 E |

OTHER PUBLICATIONS

"Taylor-Made Golf Company 1983 Advertisement" Cleek Golf Club.

"Cobra Golf Co." (Advertisement) published 1982.

*Primary Examiner*—George J. Marlo

*Attorney, Agent, or Firm*—Hill, Van Santen, Steadman & Simpson

[57] ABSTRACT

A utility golf club wood is provided with a single fragmental spherical, preferably less than hemispherical, projection or bump on the central portion on the bottom or sole behind the sweet spot of the impact face to minimize the size of divots when the club head is swung through the turf while at the same time accommodating wide variations in the angle of the club swing and the inclination of the club head. The single projection presents the same circular contour to the turf regardless of wide variations in the angle of swing thereby accommodating the fade and draw shots and also accommodates front to rear rocking of the club head to accommodate variations in the pitch angle of the club face. The club is thus useful for many different shots both in the rough and on the fairway. The single round bump or projection adds mass behind the sweet spot of the club face without materially increasing the weight of the club head and at the same time reduces the turf drag to produce longer and more accurate drives. The single round bump is surrounded by a rim or margin of substantially flat bottom surface of the club head.

2 Claims, 7 Drawing Figures

FIG. 4
FIG. 4A
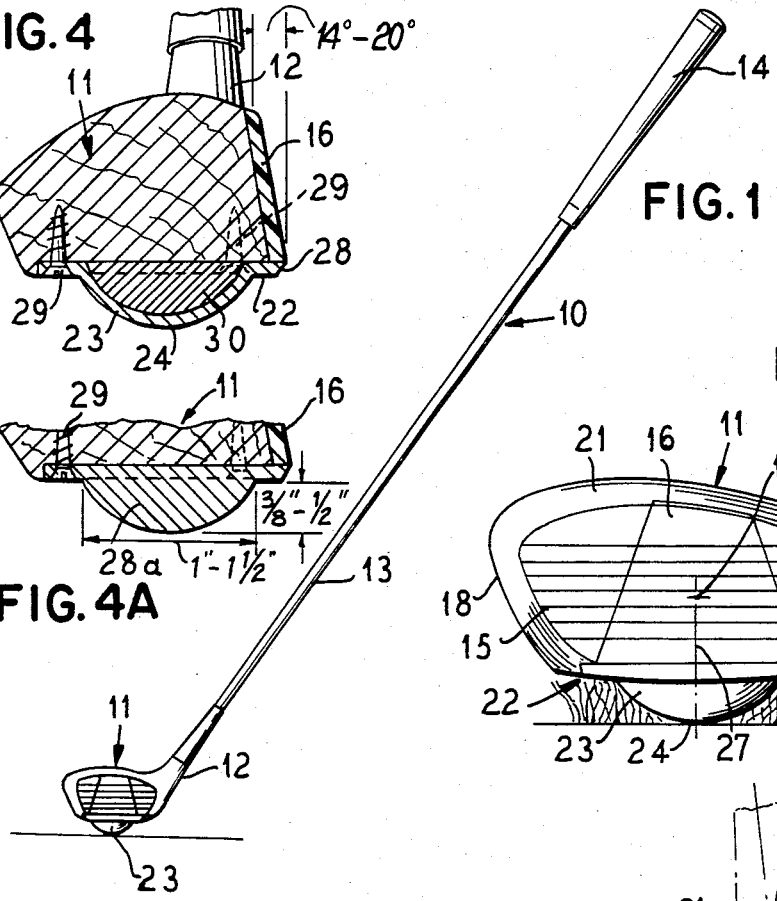
FIG. 1
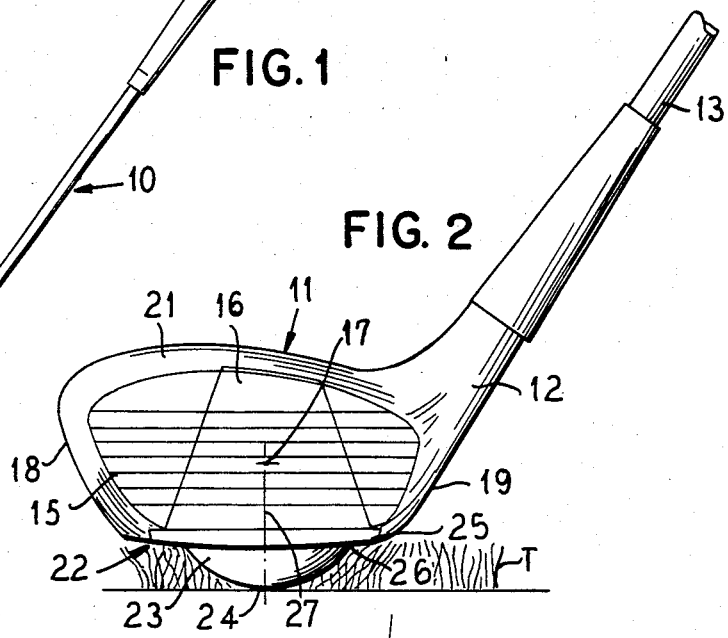
FIG. 2
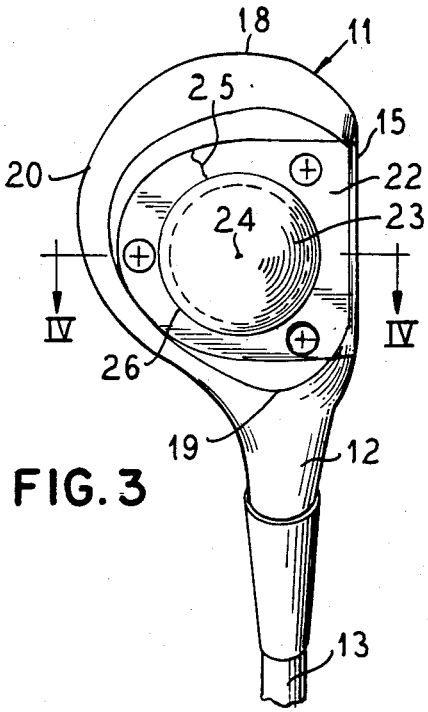
FIG. 3
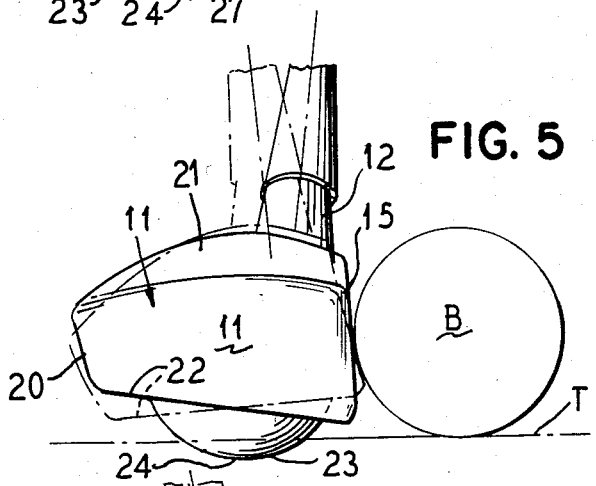
FIG. 5
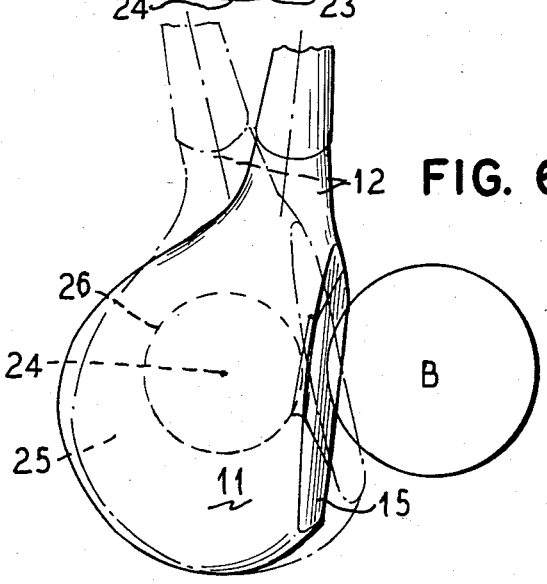
FIG. 6

GOLF CLUB

FIELD OF THE INVENTION

This invention relates to the art of golf club woods and particularly deals with a golf club wood having a fragmental spherical, preferably less than a hemisphere, bump or projection on the central portion of the bottom face thereof behind the sweet spot of the impact face.

BACKGROUND OF THE INVENTION

Golf club woods conventionally have substantially flat bottom faces or sole plates requiring the golfer to accurately position and swing the club with this face parallel to the turf. Deviations from this parallel relationship create divots impeding the speed of the swing and forcing twisting or turning of the club head. Good shots thus required perfect swings and variations in distances to be covered by the drive required the golfer to carry a whole set of woods with different loft angles of the impact or striking face.

PRIOR ART

So-called "utility" golf club woods have been provided so that a single club will accommodate different types of shots. Some of these "utility" woods were provided with longitudinally extending ribs, grooves, and other projections on the bottom face thereof in an attempt to lessen turf drag. These front to rear projections, however, could not accommodate appreciable front to rear tilting of the club head or angular swinging of the impact face from a 90° impact position relative to the ball. Such variations produced scuffed or deep divots thus destroying or reducing the effectiveness of the drive.

It would be an improvement in this art to provide utility golf club woods with a single round or fragmental spherical bump or projection on the central portion of the bottom face or sole of the club head immediately behind the sweet spot of the club impact face to thereby reduce turf drag, produce uniform divots, and at the same time accommodate wide variations in addressing the ball and swinging the club.

SUMMARY OF THIS INVENTION

According to this invention utility golf club woods are now provided with a single rounded projection or bump of circular cross-sections on the central portion of the bottom face or sole plate thereof to minimize turf drag while at the same time accommodating wide variations in swinging and rocking of the club. The round projection is preferably less than hemispherical with the major circle diameter thereof being less than the front to rear length of the sole to provide a substantially flat sole margin therearound so that the golfer can set the golf head down on the turf to take his grip. The round single bottom bump will produce the same amount of divot for wide variations in the angle of swing and wide variations in tilting of the club head from a parallel position to the turf. The bump will not twist the club head on off-center hits, will add mass behind the point of impact to the ball, will reduce turf drag and will produce the same impact divot through a wide variation of shots.

It is then an object of this invention to provide a golf club wood with a single fragmental spherical protuberance on the central portion of the bottom of the club head accommodating front to rear tilting and lateral swinging of the club head without changing the type of divot produced by the club.

Another object of this invention is to provide a golf club wood with a substantially flat sole having a fragmental spherical bump behind the sweet spot of the striking face in the central portion of the sole and surrounded by a flat margin.

A specific object of this invention is to provide a golf club wood head with a bottom face having a round bump of circular cross-section projecting about $\frac{3}{8}''$ to $\frac{1}{2}''$ from the central portion of the bottom face adding mass behind the sweet spot of the striking face.

Other and further objects of this invention will be apparent to those skilled in this art from the following detailed description of the annexed sheet of drawings which, by way of a best mode illustration, shows one embodiment of the invention.

ON THE DRAWINGS

FIG. 1 is a front elevational view of a golf club wood according to this invention.

FIG. 2 is an enlarged front elevational view of the head portion of the club of FIG. 1.

FIG. 3 is a bottom plan view of the head portion of the club of FIG. 2.

FIG. 4 is a front to rear cross-sectional view along the line IV—IV of FIG. 3.

FIG. 4A is a fragmental view similar to FIG. 4 but showing an alternative sole plate.

FIG. 5 is a somewhat diagrammatic end view illustrating the manner in which the club head may be rocked about its central projection to vary the inclination of the striking face.

FIG. 6 is a somewhat diagrammatic top plan view illustrating the manner in which the club may be swung laterally about the projection to accommodate fade and draw shots.

BRIEF DESCRIPTION OF THE DRAWING

The golf club wood 10 of FIG. 1 has a head 11 with an upwardly and rearwardly inclined hosel 12 receiving the lower end of a shaft 13, the upper end of which has a handgrip 14. The head 11 is of the "wood" type although it may be composed of metal, wood, or plastic material.

The head 11, as better shown in FIGS. 2 and 3, has a front striking face 15 inclined at an angle desired for a utility club such as a 14° to 20°. The front face 15 preferably has a hard plastic material insert 16 in the central portion thereof with a sweet spot 17 at the center of the horizontal and vertical axis of the club head.

The club head 11 has a conventional rounded nose 18, a heel 19 from which the hosel 12 projects, an arcuate rear face 20, and a top face 21 having a dome-like contour extending from the top edge of the striking face 15 and merging into the rounded nose 18 and the arcuate rear end 20. A bottom face or sole 22 merges into the nose 18, heel 19, and rear wall 20 extending from the bottom edge of the striking face 15 to the rear wall. As illustrated this sole 22 has a substantial front to rear dimension and is substantially flat in the front to rear direction although it is somewhat arcuate in the nose or toe to heel direction.

The central portion of the sole 22 has a round bump or projection 23, preferably in the form of a fragmental sphere centered behind the sweet spot 17 and having an apex 24 about $\frac{3}{8}$ to $\frac{1}{2}$ inch below the sole surface. This projection or bump is surrounded by a substantially flat margin 25 of the sole arranged so that when the projection 23 is pressed into the turf T shown in FIG. 2 this margin 25 will rest flat on the surface to assist the golfer in placing the club for properly addressing the ball.

The maximum circumference or great circle 26 of the projection 23 is surrounded by the planar bottom face or sole 22 providing a margin having a width 25 adapted to rest flatwise on the turf T while the projection 23 is pressed into the turf as shown in FIG. 2. The width 25 of the margin as shown in FIG. 3 is less than the diameter of the great circle 26 of the projection 23. The projection is centered on the front to rear axis of the sweet spot 17 and the pole or apex 24 of the projection is directly under but behind the sweet spot as illustrated by the dotted line 27 in FIG. 2.

The sole 22 as illustrated in FIG. 4 may be in the form of a metal plate 28 fastened to the bottom of the wood head 11 by screws 29 or it may be an integral part of the wood head 11. The projection 23 is heavy and solid to add mass behind the sweet spot 17.

As illustrated in FIG. 4 the sole plate 28 may have a hollow projection 23 receiving a heavy weight, such as lead 30 therein to increase the mass. Alternatively, as shown in FIG. 4*a*, the sole plate 28*a* may be solid in one piece.

As illustrated in FIGS. 5 and 6 the projection 23 permits rocking and tilting of the club head 11 in both fore and aft and lateral directions. FIG. 5 shows how the club head 11 may be tilted to present the striking face 15 to the ball B in a downward direction or in an upward direction thereby varying the inclination of the striking face to accommodate different types of shots. The club head is easily rocked on the apex 24 of the projection 23 to accommodate this front to rear tilting.

As illustrated in FIG. 6 the club head may also be swung laterally to present the striking face 15 toward or away from the golfer. Thus, the club is easily pivoted about the apex 24 of the projection 23 to accommodate inward or outward positions of the striking face so that the golfer need not position the striking face 90° to the ball.

The projection 23, being circular in cross-section, will take the same type of divot for the different positions of the club head thereby preventing scuffed shots and twisting of the club head at impact. The great circle of this projection may vary from 1" to 1½" in diameter accommodating club heads of different sizes and providing flat sole margins so that the golfer may easily rest the club head flatwise on the turf when addressing the ball.

From the above descriptions it will be understood that this invention provides a utility golf club wood with a single round circular cross-section projection or bump behind the sweet spot of the striking face providing a tilting axis for the club head, adding mass to the impact and accommodating variations in front to rear and lateral swinging of the club head without changing the divot produced by the club head.

I claim:

1. A driving type golf club which comprises a shaft, a head on the bottom of the end of the shaft, a hand grip on the top end of the shaft, said head having an arcuate toe, a heel with an upwardly and rearwardly inclined hosel receiving the bottom end of the shaft, an upstanding front striking face inclined rearwardly 14° to 20° and having a central sweet spot, an arcuate rear wall, a domed top, a planar sole generally flat in a front to rear direction, and a single fragmental spherical projection on the central portion of the sole having an apex under and directly behind the sweet spot, said projection being integral with the sole and having a great circle diameter of 1 to 1½ inches and projecting ⅜ to ½ inch below the sole, said planar sole having a margin surrounding the projection of less width than the diameter of the projection adapted to rest flatwise on the turf with the projection pressed into the turf and the contour of said projection producing similar divots for a wide range of tilting and swinging angles of the club.

2. A golf head for a driving type golf club which comprises a member having a round nose, an arcuate back, a round heel, a hosel extending upwardly and rearwardly from the heel, a top, an upstanding front striking face inclined rearwardly 14° to 20° and having a central sweet spot, a generally flat sole, a single fragmental spherical projection integral with and depending from the central portion of the sole centered behind the sweet spot, said projection having a major diameter of 1 to 1½ inches and extending ⅜ to ½ inch below the sole, and said sole having a margin surrounding the projection of less width than said major diameter of the projection.

* * * * *